US008935919B2

(12) United States Patent
Andersson et al.

(10) Patent No.: US 8,935,919 B2
(45) Date of Patent: Jan. 20, 2015

(54) METHOD AND DEVICE FOR CONTROLLING A HYDRAULIC SYSTEM

(75) Inventors: Bo Andersson, Jönköping (SE); Bertil Lundgren, Bjärtrå (SE)

(73) Assignee: Nordhydraulic AB, Kramfos (SE)

( * ) Notice: Subject to any disclaimer, the term of this patent is extended or adjusted under 35 U.S.C. 154(b) by 563 days.

(21) Appl. No.: 13/378,404

(22) PCT Filed: Jun. 23, 2010

(86) PCT No.: PCT/SE2010/050720

§ 371 (c)(1),
(2), (4) Date: Dec. 15, 2011

(87) PCT Pub. No.: WO2010/151220

PCT Pub. Date: Dec. 29, 2010

(65) Prior Publication Data

US 2012/0090690 A1 Apr. 19, 2012

(30) Foreign Application Priority Data

Jun. 24, 2009 (SE) ..... 0900864

(51) Int. Cl.

| | |
|---|---|
| ***F15B 13/02*** | (2006.01) |
| ***E02F 9/22*** | (2006.01) |
| ***B66C 13/18*** | (2006.01) |
| ***B66F 9/22*** | (2006.01) |
| ***F15B 13/04*** | (2006.01) |
| ***F15B 11/16*** | (2006.01) |

(52) U.S. Cl.

CPC ..... *E02F 9/2203* (2013.01); *B66C 13/18* (2013.01); *B66F 9/22* (2013.01); *E02F 9/2217* (2013.01); *E02F 9/2267* (2013.01); *F15B 13/0416* (2013.01); *F15B 11/165* (2013.01); *F15B 2211/20538* (2013.01); *F15B 2211/253* (2013.01); *F15B 2211/50536* (2013.01); *F15B 2211/528* (2013.01); *F15B 2211/57* (2013.01); *F15B 2211/5753* (2013.01); *F15B 2211/6051* (2013.01); *F15B 2211/653* (2013.01)

USPC ..... 60/468

(58) Field of Classification Search

USPC ..... 60/468

See application file for complete search history.

(56) References Cited

U.S. PATENT DOCUMENTS 4,167,893 A 9/1979 Johnson
4,327,549 A * 5/1982 Bianchetta et al. ..... 60/468

(Continued)

OTHER PUBLICATIONS

International Search Report for PCT/SE2010/050720.

*Primary Examiner* — F. Daniel Lopez

(74) *Attorney, Agent, or Firm* — Marvin Petry; Stites & Harbison PLLC

(57) ABSTRACT

A method and a device for controlling a load sensing hydraulic system, having a bypass valve (F), which is controlled by a pump pressure (P) and which when the hydraulic system is in operation diverts a pump flow of hydraulic fluid to a tank (E). The bypass valve (F) is pre-stressed towards a closed position and is put on load by the pump pressure (P) towards an open position against the action of the pre-stress. When the hydraulic system operates in a idling operation a first pre-stress element (I) limits the pre-stress to a first pressure and upon activation of the hydraulic system, a pressure regulator (10) increases the pre-stress to a second, substantially higher pressure by applying a hydraulic, constant second pre-stress force, that is added to the first pre-stress force and is substantially greater than this.

10 Claims, 5 Drawing Sheets

(56) References Cited

U.S. PATENT DOCUMENTS 4,418,710 A 12/1983 Johnson
5,333,449 A * 8/1994 Takahashi et al. ..... 91/446
5,579,642 A * 12/1996 Wilke et al. ..... 91/446
5,685,146 A * 11/1997 Takeuchi et al. ..... 60/468
5,950,429 A * 9/1999 Hamkins ..... 91/446

* cited by examiner 19
16
I
13
17
12
24
29
17A
26
30
10
D
23
27B
28
27A
K
J
22
27
31
32
11,L
B
21
M
36
25
34
33
20
H
F
G
35
18
14
12
15
E
C 14
12
15
18
20
25
21
23
28
27
26
24
12
17
13
I
19
16
35
G
F
H
33
36
34
31
32
27A
29
30
17A
27B
J
K
11, L
B
D
C
E 11
12
24
26
23
28
22
21
25
20
14
15
12
16
19
I
13
29
30
17A
10
D
27A
27B
31
32
27
K
J
11,L
B
34
36
33
H
F
G
35
C
E 14
12
15
18
20
25
21
22
28
23
26
24
12
17
13
I
19
16
38
37
D
40
17A
27B
K
J
11,L
B
36
33
H
F
G
35
34
M
27
27A
31
32
30
29
C
E

METHOD AND DEVICE FOR CONTROLLING A HYDRAULIC SYSTEM

The invention relates to a load sensing hydraulic systems and more specifically to a method and a bypass valve device for controlling such a hydraulic system. Herein, a hydraulic system more precisely refers to hydraulic systems that involve hydrostatic motors, such as e.g. hydraulic cylinders.

Especially, in mobile hydraulic systems, such as e.g. vehicle borne hydraulic manoeuvred load handling cranes, it is common to use hydrostatic pumps with a fixed displacement to supply the hydrostatic motors (especially work cylinders) with a pressurized hydraulic fluid. Valves are arranged between the pump and the motors, which valves control the pressure and the flow to the different hydraulic motor functions.

The hydraulic system involves an inlet section with a bypass valve, which in an open position connects the outlet of the pump to a tank for hydraulic fluid. The bypass valve is normally closed due to the action of a pre-stress, normally achieved by a compression spring, but is opened at a certain relatively low pressure, i.e. the pre-stress pressure, often denoted ΔP, for example 10-20 bar, which is needed in the system as a no-load pressure, i.e. when no hydraulic work function is activated. When a hydraulic work function is to be activated by the opening of a control valve in order to release a flow to the motor that executes that function, the pump must be able to deliver a flow with a pressure that is considerably higher than the no-load pressure, often several dozens times the no-load pressure.

Upon the activation of a hydraulic work function the bypass valve is involved in adjusting the pump pressure upwards, in dependence of a sensed load pressure signal, to a certain level above ΔP that is needed for that function or, if several work functions are to be executed simultaneously, so much over ΔP that is needed for the most pressure demanding of the different work functions. This is achieved in that the pressure downstream of the control valve, the load pressure, is sensed and conveyed to the bypass valve and acts upon it in the closing direction in interaction with the pre-stress pressure, so that the pump is forced to raise the pressure of the delivered flow to the desired level.

The pressure drop over the bypass valve causes a power dissipation that is proportional to the product of the (constant) pump flow and the pressure drop. This power dissipation is constantly present as the pump is working and even so when the hydraulic system is in idle mode. In many cases the idling operation constitutes a major part of the total operational time and it is therefore desirable to reduce the idling power dissipation as much as possible, especially since this power dissipation often requires the hydraulic system to be furnished with an important cooling system.

In electrically controlled hydraulic systems it is known and relatively uncomplicated to lower the power dissipation at idling by providing the system with an electrically controlled relief valve, which lowers the pump pressure as soon as the system passes from executing one or several work functions to work in the no-load mode (idling). In the commonly available systems with mechanically controlled control valves a lowering of the idling pressure must be performed in a hydraulic or hydraulic mechanical manner.

For hydraulic systems with mechanical or hydraulic mechanical manoeuvred control valves it is conventional to provide the bypass valve with a hydraulic auxiliary cylinder and a governing relief valve. The relief valve is normally open and allows the auxiliary cylinder to act contrary to the pre-stress with a pressure that is equal to the no-load pressure of the pump in order to reduce the effective pre-stress, and hence the idling pressure of the pump, to e.g. half of the effective pre-stress that acts when the pump is in active operation for executing a work function. When the control valve is opened in order to activate a work function, the sensed load pressure closes the relief valve, such that the auxiliary cylinder is relieved and such that the bypass valve is subsequently loaded to full pre-stress and operates at this pre-stress.

Both of the conventional solutions to the problem mentioned above of reducing the idling power dissipation have several drawbacks; the structures are complicated and expensive, and it is difficult to get the bypass valve to load to maximum pre-stress if the sensed load pressure is very far below the maximum pre-stress pressure. Therefore, in order to accomplish the loading in a reliable manner the idling pressure may not be set too far below the maximum pre-stress pressure, which sets a high limit for the reduction of the idling power dissipations.

The present invention remedies the described drawbacks and provides a method and a bypass valve device for controlling a load sensing hydraulic system that allows a low idling pressure but reliably loads the bypass valve to a higher pre-stress pressure when one or several hydraulic work functions are to be activated.

In accordance with the invention the bypass valves pre-stress is set to a first or lower pressure for idling, e.g. 3 bar, that is substantially lower than a set second and higher pressure, often 10-20 bar, at which the hydraulic system shall operate when one or several motors in the system shall execute a work function, e.g. raise a load. When a motor in the hydraulic system is activated by the opening of a control valve for the motor, a unique hydraulic pressure regulator sees to that the pump pressure is raised from the first pressure to the preset second pressure that shall reign when a hydraulic work function is activated. In correspondence, the second pressure is automatically reduced back to the first pressure when no hydraulic work function is executed.

The values of the first pressure and the second pressure and the difference or relation between these pressures are appropriately chosen with respect to the structure, applicability and characteristics of the hydraulic system and may therefore vary within certain intervals. Both the first lower pressure and the second higher pressure should on the one hand be as low as possible but on the other hand be sufficiently high for the hydraulic system to reliably (1) open the bypass valve to a position corresponding to the first pressure, (2) adjust the pump pressure upwards to the second, higher pressure when a control valve is opened for activation of a work function, and (3) return to the first pressure as soon as all work functions have been de-activated. As a general rule, which is valid for several mobile hydraulic systems, the first pressure should be at least about 3 bar and the second pressure should be at least the double of the first pressure.

The invention and its features are further enlightened in the following description of an exemplifying embodiment that is schematically shown in the accompanying drawings.

Figure 2:
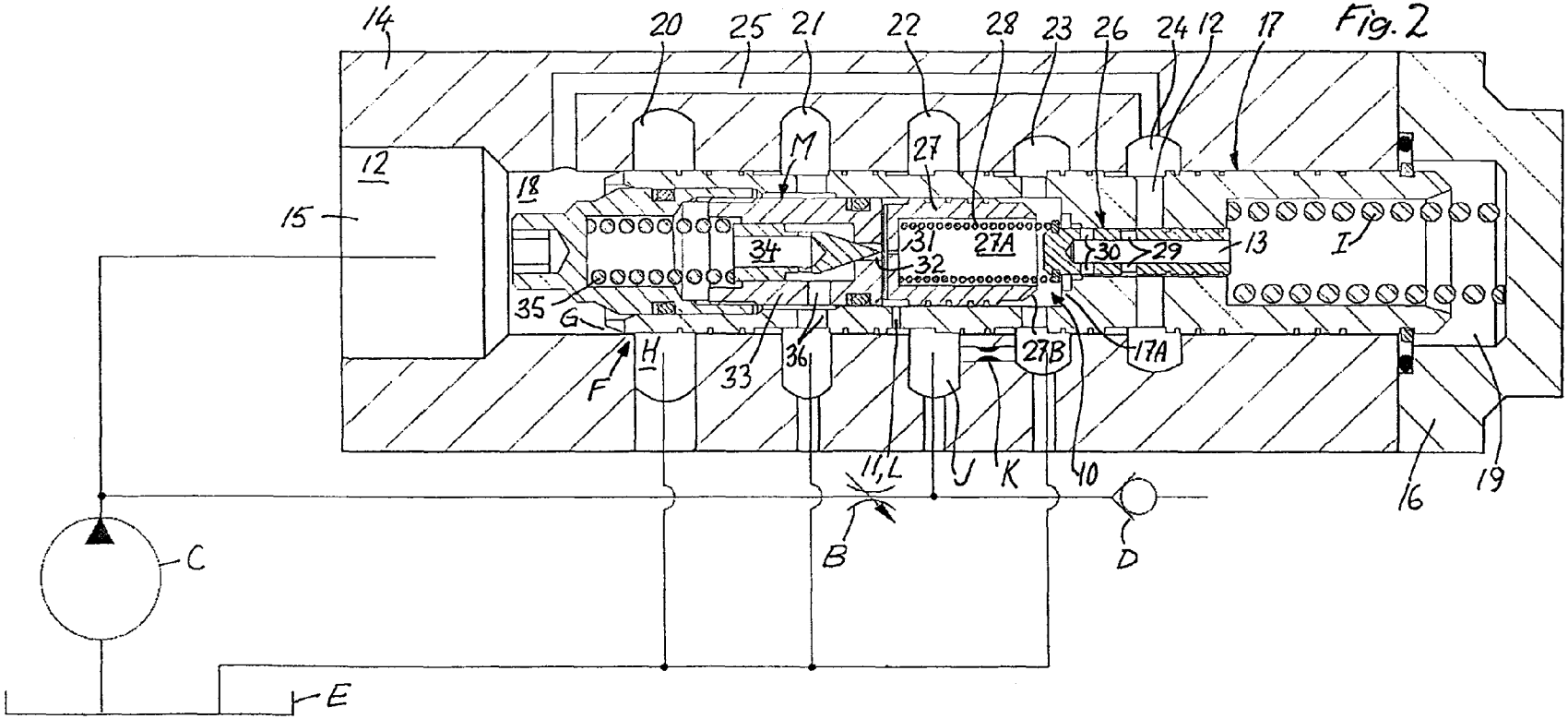
FIG. 2 shows a longitudinal section of a bypass valve device in accordance with the embodiment of FIG. 1 provided with a bypass valve, a pressure regulator and a pressure relief valve, which are integrated in a common body, wherein the components are shown in the position they assume when the hydraulic system is at rest.
Figure 4:
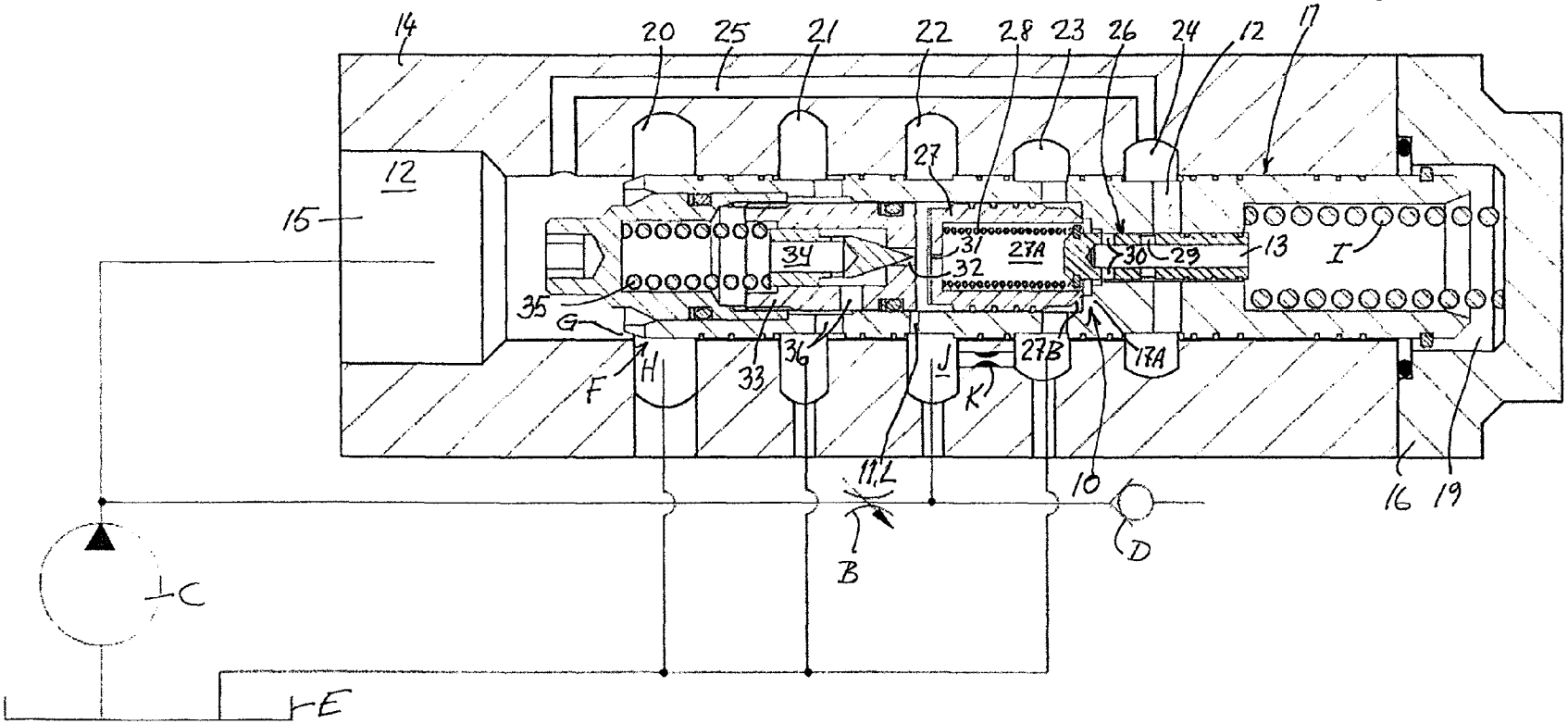
Figure 5:
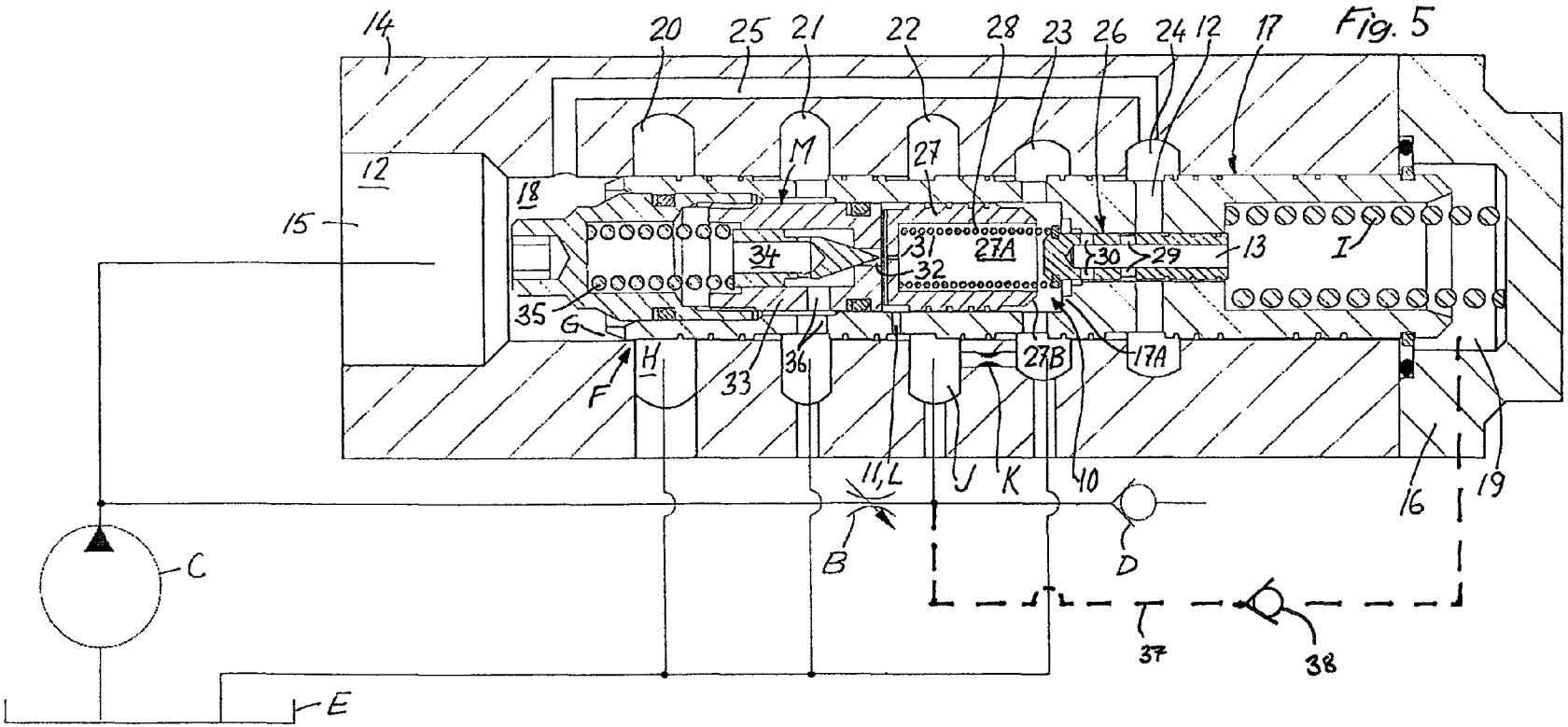

FIG. 4 shows the same longitudinal section as FIG. 2 but with the components shown in the positions they assume when the hydraulic system is activated in order to execute a work function involving the raising of a load; and FIG. 5 shows a longitudinal section of a bypass valve device in accordance with a second embodiment of the invention, which is completed with an additional conduit and non-return valve, wherein the components are shown in the position they assume when the hydraulic system is at rest.

Figure 1:
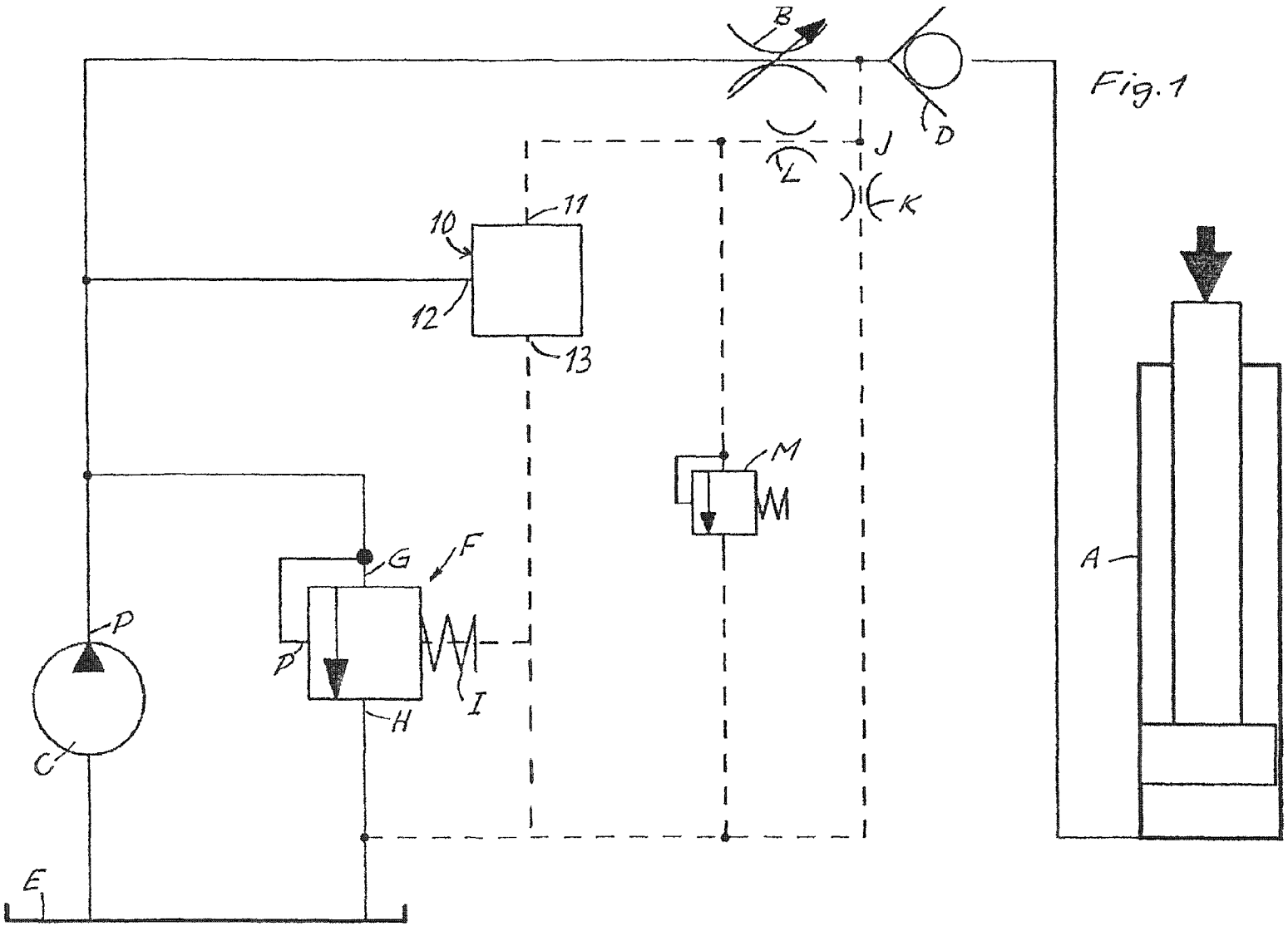
FIG. 1 shows a diagram of an exemplifying embodiment of the invention.

An exemplifying embodiment of the bypass valve device according to the invention is schematically shown in FIG. 1. The shown embodiment is intended to be used for controlling a hydraulic system for a hydraulic motor in the form of a single acting hydraulic cylinder A, of which the piston movements are controlled by means of a control valve B, which on one end is connected to a hydraulic pump C with a fixed displacement and on the other end is connected to the piston end of the hydraulic cylinder via a non return valve D, which opens in direction towards the cylinder A. The piston rod end of the cylinder is connected, in a manner not shown, to a tank E via the control valve B. The hydraulic system may of course have several hydraulic motors connected to the pump and the tank in corresponding manners and controlled by individual control valves. The hydraulic cylinder A may of course also be a double acting cylinder and additional hydraulic motors, if there are any, may be either single acting or double acting.

In a conventional manner, the shown hydraulic system includes a normally closed bypass valve F, which is connected between the outlet on the pump C and the tank E. The bypass valve F controls a flow passage between a flow inlet G and a flow outlet H, by means of a valve element, e.g. a slide (not shown), in dependence of both the pump pressure (the pressure at the outlet of the pump), and a pre-stress element in the form of a pre-stress spring I that acts on one end of the valve element in the closing direction in order to counteract the pump pressure P on the other end of the valve element.

In the flow conduit between the control valve B and the non return valve D there is a load sensing point J, which communicates with the tank E via a restrictor K, and with the input on a pressure relief valve M of which the outlet is connected to the tank E. Further, the restrictor L is also connected to the tank E, farther up and closer to the described pressure regulator 10, in order to limit the pressure on it by means of the pressure relief valve M. The pressure in the load sensing point J, i.e. the load pressure, is in a conventional manner used to act upon the bypass valve F in the closing direction. However, in accordance with the invention this is achieved in a substantially different manner than what has been conventional.

According to the invention a pressure regulator 10 is located between the pressure sensing point J and the bypass valve F, having a first pressure signal input port 11, which transmits the sensed load pressure to the pressure regulator via the restrictor L, and further, a second pressure signal input port 12, which transmits the pump pressure to the pressure regulator, and a pressure signal output port 13 that is conducted to the bypass valve F in order for it to conduct an output pressure to act in the closing direction on the valve element of the bypass valve.

Below the function of the bypass valve device shown in FIG. 1 is described.

At idling, when the pump C operates towards a closed control valve B, the load sensing point J is without pressure (the pressure sensing point J communicates with the tank E via the restrictor K and is drained on leak flow, if any). The pump pressure P is conveyed directly to the control input of the bypass valve F and keeps the valve element of the bypass valve displaced against the action of the pre-stress element (the compression spring) I to an open position, such that the pump flow may pass back to the tank H through the passage between the flow inlet G and the flow outlet H at a pressure drop that is determined by the pre-stress element I. This pressure drop is in this case assumed to be 3 bar.

Figure 3:
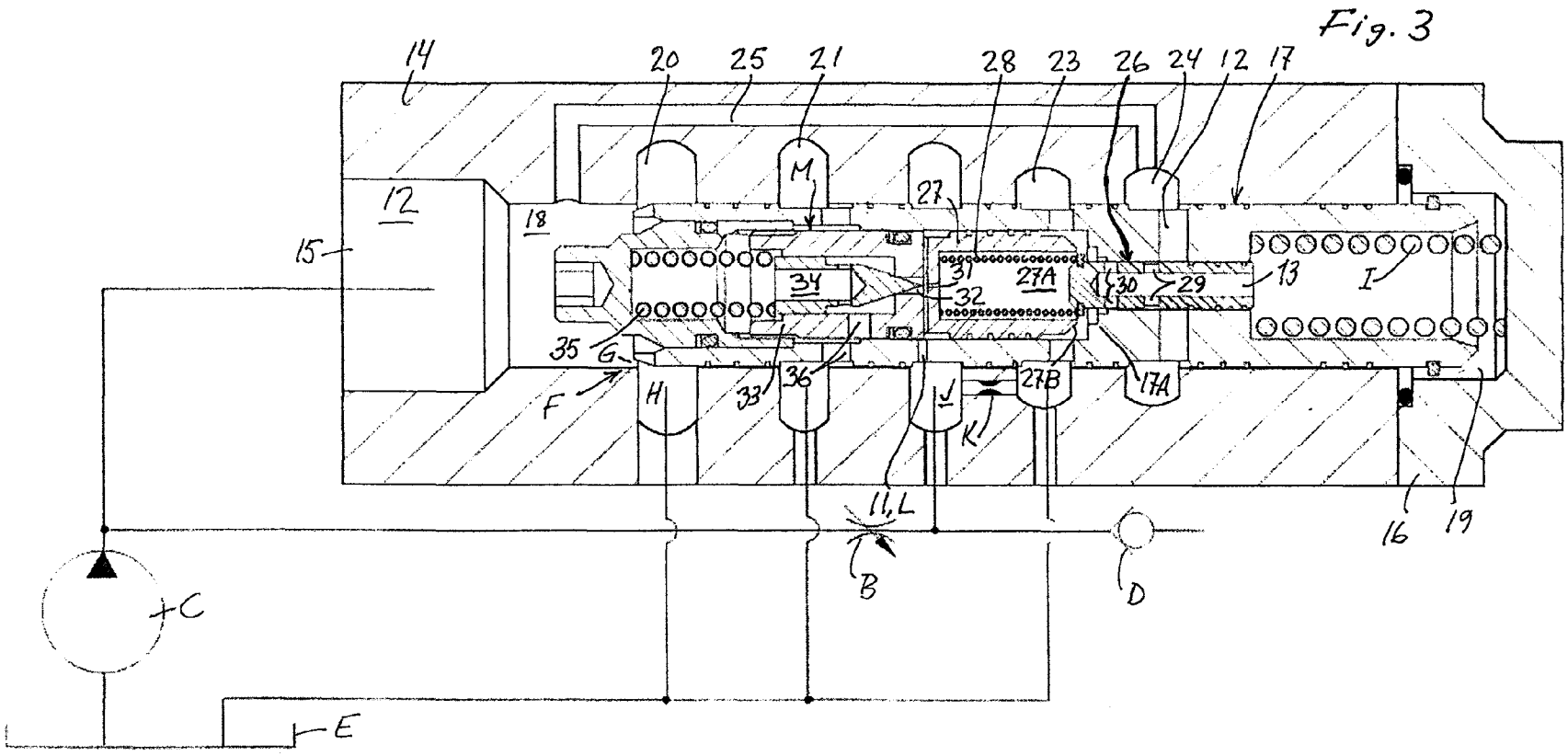
FIG. 3 shows the same longitudinal section as FIG. 2, but with the components shown in the positions they assume when the hydraulic system operates in a idling operation (no load)

The pump pressure P is also conveyed directly to the second pressure signal input port 12 on the pressure regulator 10, but, as will be apparent from the following detailed description of the pressure regulator 10 with reference to FIGS. 2-4, the pump pressure P in an idling operation mode causes no flow through the pressure regulator. In this mode the pressure signal input port 11 on the pressure regulator 10 is without pressure due to the communication with the tank E via the restrictors L and K, and as will be apparent from the following, the pressure signal output port 13 of the pressure regulator 10 is also without pressure, such that the pressure regulator 10 has no effect. The whole pump flow that the pump pressure P generates therefore passes through the bypass valve F back to the tank E with a pressure drop of 3 bar.

A work function that consists of a displacement upwards of the piston in the hydraulic cylinder A, against the action of the gravity force of a load that is to be raised and is represented by a downwardly directed arrow in FIG. 1, is activated by opening of the control valve B in order to connect the pump C to the cylinder A via the non return valve D. The non return valve D is initially kept in a closed position from the action of the load pressure, which in this case is assumed to be 100 bar. Therefore, there is initially no flow to the cylinder A, but on the other hand the load sensing point J and hence the first pressure signal input port 11 on the pressure regulator 10, are set to the pump pressure P. As will be apparent from the description of FIGS. 2-4, the pressure regulator 10 transmits the pump pressure P to the bypass valve F, where the pump pressure acts in the same direction as the pre-stress element I, i.e. such that it strives to displace the valve element of the bypass valve in the closing direction in interaction with the pre-stress element. As a consequence, the pump C is forced to raise the pump pressure P in proportion to the pressure that corresponds to the increased hydraulic closing force on the bypass valve element, which implies that the pre-stress of the bypass valve rises to a higher value.

The raise of the pump pressure, and hence of the hydraulic closing force on the valve element of the bypass valve, practically instantaneously continues up to a set value determined by the pressure regulator 10, which here is assumed to be 12 bar, and subsequently, also practically instantaneously to a value that just barely is enough to raise the load that acts on the piston in the hydraulic cylinder A to be raised, i.e. 115 bar. At this moment the pressure drop over the bypass valve F equals 15 bar, whereof 3 bar resides from the pre-stress element of the bypass valve and 12 bar resides from the hydraulic pre-stress force that the pressure regulator 10 causes. The load on the hydraulic cylinder A causes a load pressure of 100 bar.

When the control valve B and hence the non return valve D are closed, the load sensing point J and the first pressure signal input port 11 of the pressure regulator 10 are relieved to the tank E through the restrictor K, and at the same time the pressure signal output port 13 of the pressure regulator is also relieved to the tank, such that only the lower pre-stress corresponding to 3 bar caused by the pre-stress element in the bypass valve F acts on the pressure regulator. At this point, the pump pressure P and hence the pressure on the second pressure signal input port 12 falls back to 3 bar. The pump P will therefore once again provide a flow that has a pressure of 3 bar and is directly diverted to the tank E.

FIG. 2-4 shows a longitudinal section of an embodiment of the bypass valve device according to the invention with the components in three different mutual positions. In FIG. 2, their mutual positions that correspond to a point at which the hydraulic system is at rest is shown (the pump C closed), wherein the whole hydraulic system except the hydraulic cylinder A and the non return valve D is without hydraulic pressure; in FIG. 3 the position when the system operates in idling operation is shown (no work function activated); and in FIG. 4 the position when a work function in the system is activated in order to raise a load is shown (the pump pressure is sufficiently high in order to raise the load). Most of the reference numerals in FIG. 1 also appear in FIG. 2-4 accompanied with further reference numerals.

The bypass valve device has an elongated body 14 with a pump port 15 at a first end, in FIG. 2-4 the left end, and an end block 16 at the opposite, right end. An outer valve slide (bypass valve slide) 17 is movably arranged in a slide channel 18, that extends from the pump port 15 to a chamber 19 in the end block 16, where the pre-stress element I, in the form of a compression spring is supported by the end block at one end and by the right end of the outer valve slide 17 at the other end in order to pre-stress it in the direction towards the pump port 15.

A number of recesses are arranged along the slide channel 18, which recesses are annular and communicate with the tank E. At a short distance inside of the pump port 15 such a recess 20 is arranged and forms the outlet H on the bypass valve F. To the right of the recess 20 another recess 21 is located, which interconnects the inlet of the pressure relief valve M and the first pressure signal input port 11 to the tank E via the restrictors L and K. To the right of the recess 21 another recess 22 is located, which forms the load sensing point J and connects this to the first pressure signal input port 11 on the pressure regulator 10 and to the restrictor K. Farther away from the pump port 15 a recess 23 follows, which is in constant open connection to the tank E for a reason that will be explained below. Finally, following the just mentioned recess 23 a recess 24 is located, which is in constant open connection with the pump port 15 via a channel 25 in the body 14 and with the second pressure signal input port 12 on the pressure regulator 10.

The pressure regulator 10, mainly consists of three coaxial parts, that are axially movable inside the outer valve slide 17, namely an inner valve slide (regulator valve slide) 26, a valve organ 27 and a compression spring 28, which is located between the inner valve slide 26 and the valve organ 27. The greater part of the compression spring 28 is located inside a spring chamber 27A inside the valve organ 27 and is at one end supported by the valve organ and at its other end supported by a first end of the inner valve slide 26.

The inner valve slide 26 is closed at the end that supports the compression spring 28, but for the greater part of its length it is open towards the open right end of the outer valve slide 17 via an axial channel such that the it is in open communication with the chamber 19 in the end block 16. When it is displaced to the right into a first axial position, the inner valve slide 26 connects the second pressure signal input port 12 on the pressure regulator 10 with the chamber 19 via radial openings 29, and when displaced to the left into a second axial position the inner valve slide 26 connects, via secondary radial openings 30, the chamber 19 to the space in the outer valve slide where the valve organ 27 and the compression spring 28 are arranged, i.e. the spring chamber 27A.

The spring chamber 27A in the valve organ 27 has a greater diameter than the adjacent end of the inner valve slide 26, such that the front end of the valve organ 27 may receive this end of the inner valve slide 26. The outer surface 27B of the valve organ 27, facing the opposite end part of the valve slide is conical in order to form a valve element that may form a seal by interaction with a corresponding valve element 17A formed by an annular edge on the outer valve slide 17.

On one side of the valve organ 27, i.e. the side that faces away from the inner valve slide 26, there is a restrictor opening 31, through which the spring chamber 27A can communicate with the first pressure signal input port 11 on the pressure regulator 10.

The pressure relief valve M functions in a known manner to prevent a too important raise of pressure in the hydraulic system by opening of a relief passage to the tank E. The pressure relief valve M is located inside the outer valve slide 17 in the part of it that faces the pump port 15. If the pressure at the load sensing point J and hence the pressure on a control opening 32 in the housing 33 of the pressure relief valve rises above a set maximum threshold pressure, a valve organ 34 is displaced against the action of a compression spring 35 to an open position in order to connect the load sensing point J to the tank E, via both an outlet passage 36 in both the housing 33 and the outer slide 17, and via the recess 21 in the body 14.

When, as is shown in FIG. 2, the hydraulic system is at rest (the pump C closed) and hence not pressurized, the pre-stress spring I keeps the outer valve slide 17 of the bypass valve displaced to a shown closed position determined by a stop formation. The inner valve slide 26 is substantially unloaded.

When, as is shown in FIG. 3, the pump C is in operation with the control valve B in a closed position, such that no load pressure acts on the bypass valve device (idling), the pump pressure P acts on the outer slide 17 of the bypass valve F with a force that is proportional to the cross sectional area of the outer slide channel 18 of the body 14, i.e. via the inlet G to the outlet H. The outer valve slide 17 is displaced to an open position in order to allow a flow driven by the pump pressure P pass directly back to the tank E through the recess 20 of the body 14. The pump pressure P is only counteracted by the pre-stress spring I, of which the pre-stress force is assumed to 3 bar and therefore, the pump pressure will be limited to 3 bar.

The inner valve slide 26 connects the chamber 19 in the end block 16 to the spring chamber 27A, via its radial openings 30 and the space where the valve organ 27 is located. The valve formed by the valve elements 17A and 27B are in an open position, such that the chamber 19, and hence the pressure output port 13 of the pressure regulator 10, communicate with the tank E via openings in the outer valve slide 17 and the recess 23 of the body 14. Simultaneously, the restrictor opening 31 of the valve organ 27 communicates with the restrictors L and K and hence with the first pressure input port 11 on the regulator 10. In this position the inner valve slide 26 blocks the second pressure input port 12 on the pressure regulator 10, such that it has no effect, i.e. such that no flow may flow that way.

At the point when the control valve B is opened (FIG. 4) a pump pressure that is rapidly increasing from the idling pressure of 3 bar is conveyed both directly to the bypass valve F and via the channel 25 of the body 14 to the second pressure input port 12 of the pressure regulator 10, and via the control valve B to the load sensing point L and the first pressure input port 11 of the pressure regulator. The increase of pressure that is conveyed to the bypass valve F acts to increase the pump pressure P, while the pressure increase that acts on the second pressure input port 12 on the pressure regulator 10 initially has no effect. On the other hand, the pressure increase that is conveyed to the first pressure input port 11 of the pressure regulator 10 will act on the valve organ 27 and displace the valve organ 27 to the right until the valve organ 27 at its valve element 27B will be stopped by and come into sealing contact with the corresponding valve element 17A on the outer valve slide 17. The valve element will at this point compress the compression spring 28 such that the second end of the compression spring 28 exerts a force upon the inner valve slide 26 that strives to displace said slide to the right. The displacement of the valve slide 26 is counteracted by a force directed to the left caused by the pressure at the second pressure input port 12 of the pressure regulator 10, which acts on the inner valve slide 26 via the openings 29 in it.

Thus, the pressure difference between the pressure that reigns in the first pressure input port 11 and the second pressure input port 12 will be adjusted to be constantly 12 bar, i.e. as much as the spring action force with which the spring 28 acts on the inner valve slide 26. Hence, when this happens the force directed to right that the compression spring 28 exerts on the inner valve slide 26 will correspond to a pressure of 12 bar that via the openings 29 of the valve slide acts in the chamber 19 in the end block 16 to the left onto the right side of the outer valve slide 17. This valve slide is hence hydraulically loaded with a further pre-stress force that acts on the bypass valve F, such that the effective pre-stress of the bypass valve F becomes the sum of the pre-stress of the spring I corresponding to 3 bar, and the hydraulic pre-stress corresponding to 12 bar. Hence, at this point, the outer valve slide 17 diverts a flow to the tank E with a pressure drop of 15 bar.

Upon the continued increase of the pump pressure P from 15 bar up to the level where the load at the cylinder A starts to move, i.e. up until the pump pressure is 115 bar acting on the load pressure on 100 bar, the valve elements 17A and 27B will continuously be in a closed position, wherein the pressure increase will act just as much on the left as on the right side of the outer valve slide 17, whereas the pressure at the pressure output port 13 of the pressure regulator, which has been reduced by the pressure regulator 10, from that point will remain constant at 112 bar. When the load starts to move the left side of the bypass valve F will be affected by the total pump pressure P of 115 bar, while the right side will be affected by the load pressure of 100 bar, by the spring pre-stress corresponding to 3 bar, and the hydraulic pre-stress corresponding to 12 bar.

In FIG. 5, a second embodiment of the invention is shown, in which the bypass valve device is completed with an additional conduit 37 connecting the output of the control valve B to the chamber 19 in the end block 16. The conduit 37 is provided with a non return valve 38, which opens towards the chamber 19. This additional conduit 37, which may form an integral part of the bypass valve device or may be provided as an external part of the valve device, assists in rapidly building up the pressure inside the chamber 19.

The invention claimed is:

1. Method of controlling a load sensing hydraulic system with a bypass valve, which is controlled by a pump pressure and which when the hydraulic system is in operation diverts a pump flow of hydraulic fluid to a tank port and which is pre-stressed towards a closed position and by means of the pump pressure is loaded towards an open position against the action of the pre-stress, characterised in that the pre-stress is initially limited to a first pressure that is determined by a first pre-stress force, wherein the pre-stress is increased to a second, substantially higher pressure upon activation of the hydraulic system by applying a hydraulic, constant second pre-stress force, that is added to the first pre-stress force and is substantially greater than the first pre-stress force.

2. Method according to claim 1, characterised in that a pre-stress element in the form of a compression spring provides the first pre-stress force.

3. Method according to claim 1, characterised in that upon activation the hydraulic system from an idling operational mode by opening of a control valve in a pump conduit, that connects the outlet on a pump flow delivering pump with a hydraulic motor, a first pressure input port signal is conducted from a load sensing point to a first input port of a hydraulic pressure regulator, and simultaneously a second pressure input signal is conducted from the outlet of the pump to a second input port of the hydraulic pressure regulator, wherein the pressure regulator applies a constant pressure output signal on the bypass valve, that corresponds to the sum of the first pressure input signal and the second pre-stress force.

4. Bypass valve device for a load sensing hydraulic system that involves a pump pressure controlled bypass valve, which is pre-stressed towards a closed position for diverting a pump flow to a tank port when the system is in operation, which bypass valve has an inlet and an outlet for the pump flow, and a valve element, that controls a flow passage between the inlet and the outlet of the pump flow and is pre-stressed with a first pre-stress force towards a closed valve position by means of a pre-stress element and that is hydraulically slidable towards an open valve position by means of the pump pressure against the action of the first pre-stress force, characterised in a pressure regulator including a first pressure input port that is connected to a load sensing point in order to sense an operational pressure in the hydraulic system, a second pressure input port for the pump pressure and a pressure output port that is connected to the bypass valve in order to apply both the load pressure and a hydraulic second pre-stress force on the valve element, that acts in the same direction as the first pre-stress force and is substantially greater than the hydraulic second pre-stress force is substantially greater than the first pre-stress force.

5. Bypass valve device according to claim 4, characterised in that the pre-stress element is a compression spring.

6. Bypass valve device according to claim 4, characterised in that the bypass valve and the pressure regulator are arranged in a common valve body with an inlet port that forms the inlet for the pump flow, the valve element of the bypass valve is formed of a slidable outer valve slide inside the body, that houses the pressure regulator and that is in open connection to the inlet port on one side of the valve slide, and is put under the action of the pre-stress element on the opposite side of the valve slide, and a couple of channels are arranged interiorly inside the body and connect a load sensing point inside the body to the first pressure input port of the pressure regulator, and connects the inlet port of the bypass valve to the second pressure input port of the pressure regulator.

7. Bypass valve device according to claim 4, characterised in that the outer valve slide also houses a pressure relief valve that is controlled by the sensed load pressure.

8. Bypass valve device according to claim 6, characterised in that the pressure regulator involves a slidable valve organ inside the outer valve slide with a first end, that is in connection with the pressure sensing point, and a second end, that has a annular regulator valve element arranged to seal against a corresponding annular regulator valve element on the outer valve slide, a slidable inner valve slide arranged inside the outer valve slide with a pressure regulating opening, through which the second pressure input port of the pressure regulator communicates with the second end of the outer valve slide, and a second pre-stress element, which is arranged at the second end of the valve organ radially inside the annular regulator valve element of the valve organ, and which upon displacement of this regulator valve element to sealing contact with the corresponding regulator valve element loads the second pre-stress element towards the inner valve slide with a force corresponding to the hydraulic second pre-stress force.

9. Bypass valve device according to claim 8, characterised in that the first end of the valve organ has a hydraulic area that is greater than the hydraulic area of the inner valve slide and is in connection with the tank port via a restrictor opening when the regulator valve element of the valve organ is not in sealing contact with the corresponding regulator valve element on the inner valve slide.

10. Bypass valve device according to claim 8, characterised in that the second pre-stress element is a compression spring.

* * * * *